US008684099B2

(12) United States Patent
Azimi et al.

(10) Patent No.: US 8,684,099 B2
(45) Date of Patent: Apr. 1, 2014

(54) SYSTEM AND METHOD FOR FORMATION ISOLATION

(75) Inventors: Shaun Azimi, Houston, TX (US); Ricardo Martinez, Spring, TX (US); Arin Basmajian, Houston, TX (US); Frank Coss, Katy, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 74 days.

(21) Appl. No.: 12/711,336

(22) Filed: Feb. 24, 2010

(65) Prior Publication Data

US 2011/0203801 A1 Aug. 25, 2011

(51) Int. Cl.
*E21B 34/00* (2006.01)

(52) U.S. Cl.
USPC ..... 166/386; 166/332.3; 166/334.2

(58) Field of Classification Search
USPC ..... 166/332.3, 334.2, 386
See application file for complete search history.

(56) References Cited

U.S. PATENT DOCUMENTS

| | | | | | |
|---|---|---|---|---|---|
| 3,667,505 | A | | 6/1972 | Radig | |
| 3,667,557 | A | | 6/1972 | Todd et al. | |
| 4,230,185 | A | * | 10/1980 | Fredd | 166/332.3 |
| 4,444,267 | A | | 4/1984 | Beck | |
| 4,467,870 | A | * | 8/1984 | Langham | 166/321 |
| 4,560,004 | A | * | 12/1985 | Winslow et al. | 166/321 |
| 4,624,317 | A | | 11/1986 | Barrington | |
| 4,627,492 | A | * | 12/1986 | MacLaughlin | 166/250.08 |
| 5,810,087 | A | | 9/1998 | Patel | |
| 5,950,733 | A | * | 9/1999 | Patel | 166/373 |
| 6,041,864 | A | | 3/2000 | Patel | |
| 6,073,698 | A | * | 6/2000 | Schultz et al. | 166/317 |
| 6,227,298 | B1 | | 5/2001 | Patel | |
| 6,230,807 | B1 | | 5/2001 | Patel | |
| 6,302,216 | B1 | | 10/2001 | Patel | |
| 6,352,119 | B1 | | 3/2002 | Patel | |
| 6,401,826 | B2 | | 6/2002 | Patel | |
| 6,502,640 | B2 | | 1/2003 | Rassiguier | |
| 6,662,877 | B2 | | 12/2003 | Patel | |
| 6,745,834 | B2 | | 6/2004 | Davis | |
| 6,945,331 | B2 | | 9/2005 | Patel | |
| 7,347,272 | B2 | | 3/2008 | Patel | |
| 7,758,019 | B2 | * | 7/2010 | Braddick | 251/315.06 |
| 7,810,571 | B2 | * | 10/2010 | Beall | 166/334.2 |
| 2006/0272825 | A1 | * | 12/2006 | Royer | 166/373 |
| 2007/0056745 | A1 | | 3/2007 | Contant | |
| 2008/0141826 | A1 | | 6/2008 | Marya | |
| 2008/0223581 | A1 | | 9/2008 | Beall et al. | |
| 2009/0184278 | A1 | | 7/2009 | Beall et al. | |
| 2009/0242199 | A1 | | 10/2009 | Basmajian | |
| 2009/0266555 | A1 | | 10/2009 | May | |
| 2009/0266556 | A1 | | 10/2009 | Swenson | |
| 2009/0308607 | A1 | | 12/2009 | Anyan | |
| 2010/0206579 | A1 | * | 8/2010 | Guven et al. | 166/373 |

FOREIGN PATENT DOCUMENTS

| | | |
|---|---|---|
| GB | 2340860 A | 3/2000 |
| GB | 2418939 | 4/2006 |

* cited by examiner

*Primary Examiner* — Nicole Coy
(74) *Attorney, Agent, or Firm* — David J. Groesbeck; Brandon S. Clark

(57) ABSTRACT

A technique employs a formation isolation valve that utilizes a ball rotatably mounted within a valve housing. The valve is designed to enable rotation of the ball about a fixed axis without translation of the ball. Rotation of the ball is achieved by connecting an arm to the ball at a position offset from the axis of rotation. A movable mandrel also is connected to the arm to enable selective actuation of the ball.

16 Claims, 4 Drawing Sheets

SYSTEM AND METHOD FOR FORMATION ISOLATION

BACKGROUND

The following descriptions and examples are not admitted to be prior art by virtue of their inclusion in this section.

In a variety of downhole applications, flow isolation valves are used to isolate formations for reasons related to prevention of fluid loss, underbalanced well control, lubricator valve applications, and other reasons that benefit from the ability to isolate regions along a wellbore. The flow isolation valve may be a ball valve designed to provide a bidirectional pressure seal. The ball valve is moved from an open flow position to a closed position by passing a shifting tool through its center. Typically, a shifting tool is attached below perforating guns on a gun string such that when the perforating guns are pulled out of hole, the shifting tool shifts the ball of the formation isolation valve to a closed position. Once closed, the well head pressure may be safely bled off while the subject formation remains isolated. This allows the well to be suspended for days or even months.

However, the ball of the formation isolation valve also creates a barrier onto which debris is often deposited. The debris can clog the mechanism and ultimately prevent the shifting tool from dislodging the debris during efforts to open the ball. Additionally, existing ball designs employ parts that are difficult to manufacture due to dimensional instability and tight tolerance requirements. The tight tolerances and the complex designs are employed to achieve both rotation and translation of the ball within the ball valve structure. Because of the difficult design requirements, many of the parts manufactured for construction of the ball valves are scrapped, and that leads to additional expense and inefficiency.

SUMMARY

In general, embodiments of the present disclosure comprise a system and methodology for providing a formation isolation valve that utilizes a ball rotatably mounted within a valve housing. The valve is designed to enable rotation of the ball about a fixed axis without translation of the ball. Rotation of the ball is achieved by connecting an arm to the ball at a position offset from the axis of rotation. A movable mandrel also is connected to the arm to enable selective actuation of the ball.

Other or alternative features will become apparent from the following description, from the drawings, and from the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various described technologies. The drawings are as follows.

DETAILED DESCRIPTION

In the following description, numerous details are set forth to provide an understanding of the present disclosure. However, it will be understood by those of ordinary skill in the art that embodiments of the present disclosure may be practiced without these details and that numerous variations or modifications from the described embodiments may be possible. In the specification and appended claims: the terms "connect", "connection", "connected", "in connection with", "connecting", "couple", "coupled", "coupled with", and "coupling" are used to mean "in direct connection with" or "in connection with via another element"; and the term "set" is used to mean "one element" or "more than one element". As used herein, the terms "up" and "down", "upper" and "lower", "upwardly" and downwardly", "upstream" and "downstream"; "above" and "below"; and other like terms indicating relative positions above or below a given point or element are used in this description to more clearly describe some embodiments of the disclosure.

Embodiments of the present disclosure generally relate to a flow isolation valve system having a design that is simpler to manufacture and more dependable to use in a well application. The design utilizes simple, strong features that enable dependable actuation of a ball type flow isolation valve. Additionally, the component design enables manufacture with minimal material removal and less dimensional movement. The design also enables ample manufacturing tolerances because of the placement of various functional features on easy to machine pieces, such as inserts used to hold ball trunnions on which the ball of the valve is rotatably mounted. As a result, the tolerances for larger, more difficult parts within the overall assembly may be relaxed.

In one illustrative embodiment, the design of the formation isolation valve employs relatively large yolk arms that are configured to provide great strength. The yoke arms enable employment of large forces to open the ball in the event the ball becomes jammed or stuck with debris. In another embodiment, the yoke arms are replaced by rods that can be used to manipulate the ball between closed and open flow positions. In any of the embodiments, the design of the formation isolation valve also enables use of a full ball instead of a half ball and that allows for the addition of other functional features. For example, a full ball allows the use of a wiper on one side of the ball (e.g., typically at the top of the ball, nearest to the surface) to reduce debris otherwise interfering with the ball. The use of a wiper reduces the potential for jamming the ball or for incurring other interference with ball operation.

Figure 1:
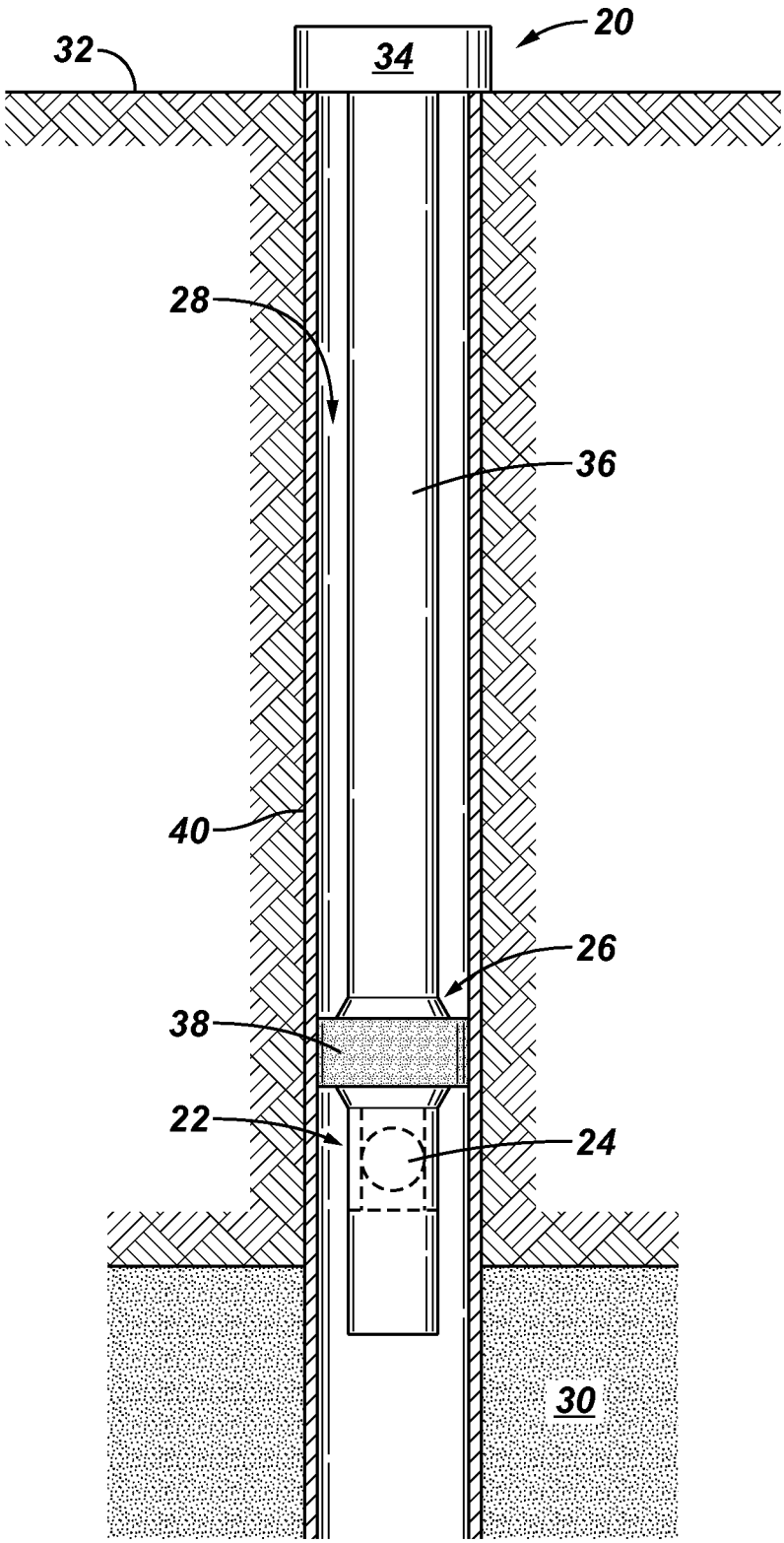
FIG. 1 is a schematic view of a well system having a formation isolation valve deployed in a wellbore, according to an embodiment of the present disclosure.

Referring generally to FIG. 1, one example of a generic well system 20 is illustrated as employing a formation isolation valve system 22 comprising at least one formation isolation valve 24. Well system 20 may comprise a completion 26 or other downhole equipment that is deployed downhole in a wellbore 28. The flow isolation valve 24 may be one of a wide variety of components included as downhole equipment 26. Generally, the wellbore 28 is drilled down into or through a formation 30 that may contain desirable fluids, such as hydrocarbon based fluids. The wellbore 28 extends down from a surface location 32 beneath a wellhead 34 or other surface equipment suitable for the given application.

Depending on the specific well application, e.g. such as a well perforation application, the completion/well equipment 26 is delivered downhole via a suitable conveyance 36. However, the conveyance 36 and the components of completion 26 often vary substantially. In many applications, one or more packers 38 is used to isolate the annulus between downhole equipment 26 and the surrounding wellbore wall, which may be in the form of a liner or casing 40. The formation isolation valve 24 may be selectively actuated to open or isolate formation 30 with respect to flow of fluid through completion 26.

Figure 2:
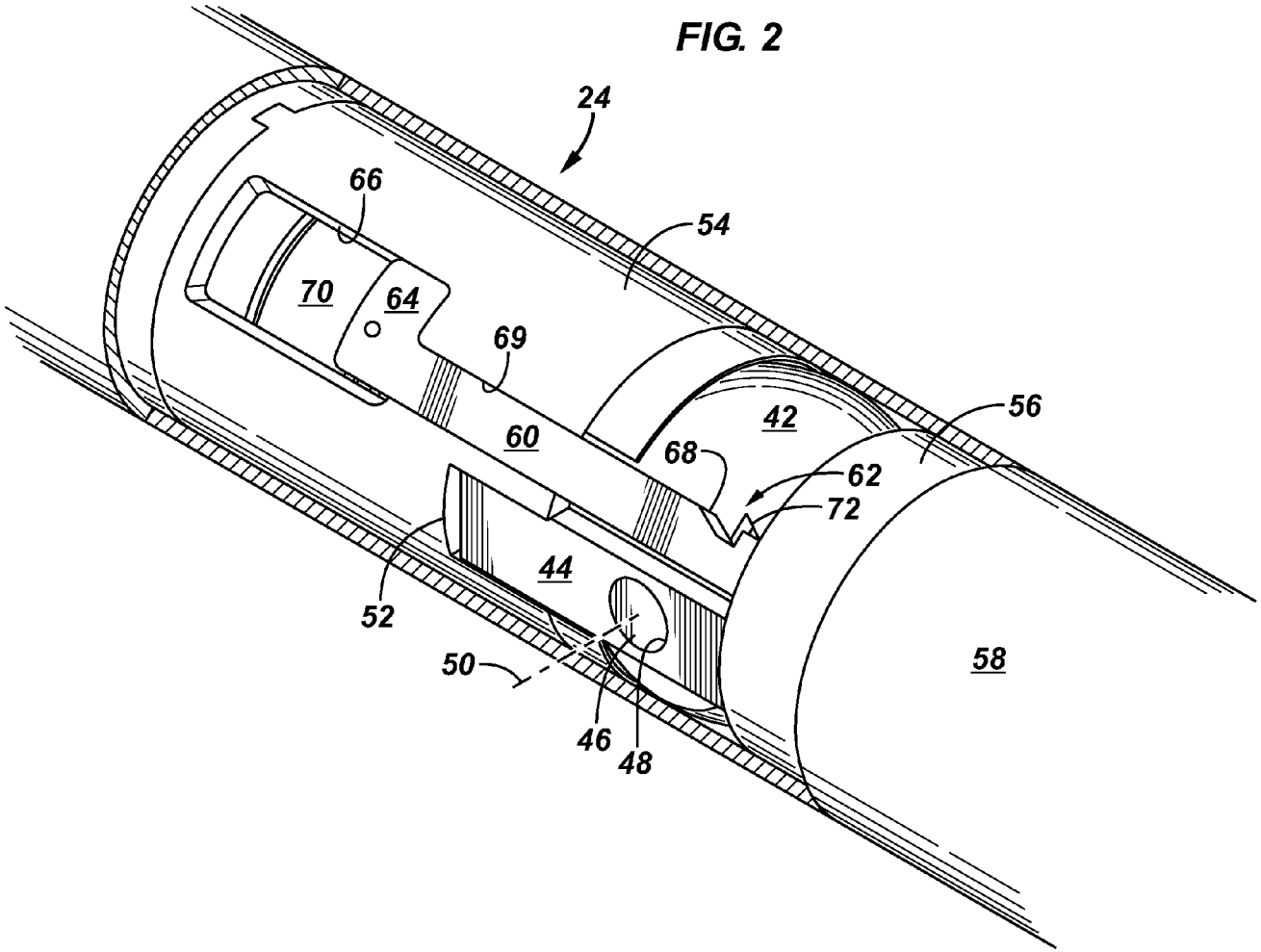
FIG. 2 is a partially broken away orthogonal view of one example of a formation isolation valve system, according to an embodiment of the present disclosure.

Referring generally to FIG. 2, one exemplary embodiment of formation isolation valve 24 is illustrated. In this embodiment, the formation isolation valve 24 comprises a ball 42 that is held in place by inserts 44, with an insert provided on each side of the ball 42 (only one is visible in this view). As illustrated, ball 42 may be a full ball rotatably mounted in inserts 44 via ball trunnions 46 that are rotatably received in corresponding openings 48 formed in the inserts. The ball 42 is thus able to rotate about a fixed axis 50 and no translation of ball 42 is required. The inserts 44 are simple to manufacture and may be formed from a plate material, such as plate steel. Each insert 44 is positioned in a pocket 52 formed in an upper cage 54 and captured between the upper cage 54 and a lower cage 56. The upper cage 54 and lower cage 56 are contained within a valve housing 58 that may be generally tubular in form. The inserts 44 hold the ball 42 in a manner that enables selective rotation of the ball via at least one arm 60.

A full ball 42 may generally be configured as a spherically shaped valve component intersected by a cylindrically shaped flow passage. This configuration results in two essentially symmetrical and semi-spherical portions of the ball 42 being respectively exposed to the upstream and downstream environments across the fixed axis 50 when the ball 42 is in a closed position. However, some embodiments may use a half ball (not shown), such as the half ball applications described in U.S. Pat. No. 6,401,826, to Patel, the contents of which are hereby incorporated by referenced in their entirety. A half ball is not necessarily symmetrical across fixed axis 50 in a closed position. Instead, a half ball may respectively expose only the upper and lower surfaces of a single semi-spherical portion to the upstream and downstream environments in a closed position.

In the embodiment illustrated in FIG. 2, the arm 60 comprises a pair of yoke arms each having an engagement end 62 and an actuation end 64 on generally opposite portions of the arm 60 (only one arm 60 is visible in this view). The arm 60 may be moved linearly to transition ball 42 between a closed position and an open flow position that enables fluid flow through an interior of formation isolation valve 24. A window 66 may be formed in upper cage 54 to receive actuation end 64 and to limit movement of actuation end 64 so as to control movement of the ball 42 to between the closed and open positions. The engagement end 62 is coupled with ball 42 at a position offset from rotation axis 50 and may move along a slot 68, formed in ball 42, when arm 60 is moved linearly. The slot 68 is formed in a desired pattern to achieve rotational movement of ball 42 between the closed and open flow positions when engagement end 62 is moved along slot 68. In some applications, the arm 60 may be guided during movement by a cage slot 69 formed in upper cage 54.

In the example illustrated, the yoke arm 60 is attached to a movable mandrel 70 at its actuation end 64. The construction enables adjustments to be made with respect to movement of arm 60 and/or the attachment of arm 60 to mandrel 70 for compensation of manufacturing tolerances. The movable mandrel 70 is simply moved in a linear direction through valve housing 58 to cause arm 60 to rotate ball 42 between open and closed positions. Accordingly, the ball 42 is actuated by pivoting the ball on its trunnions 46 without significant or, in some cases, any translation of the ball. In one specific example, the pivoting motion is caused by linear motion of arm 60/engagement end 62 which passes through slot 68 in ball 42 and contacts a face 72 to cause rotation of the ball. This type of actuation renders ball 42 and the cooperating components less sensitive to debris because the ball itself does not have to translate but rather simply rotates in place.

Movable mandrel 70 may be constructed in a variety of configurations for imparting linear movement to arm 60. In some applications, mandrel 70 may comprise a tubular member located within valve housing 58 for lineal movement along an interior of upper cage 54 (see, for example, FIG. 3). However, mandrel 70 may be constructed in a variety of configurations utilizing rods, sleeves, sliding members, pivoting members, and other mechanisms designed to impart the desired motion to arm 60. Additionally, movement of mandrel 70 may be motivated by a variety of actuation systems. For example, the mandrel 70 may be motivated hydraulically via hydraulic fluid supplied via one or more suitable control lines. In other applications, the mandrel 70 may be motivated mechanically by shifting the tubing string or running a shifting tool downhole through conveyance 36. However, motor driven systems, electric systems, and other types of systems may also be employed to enable controlled movement of mandrel 70.

Figure 3:
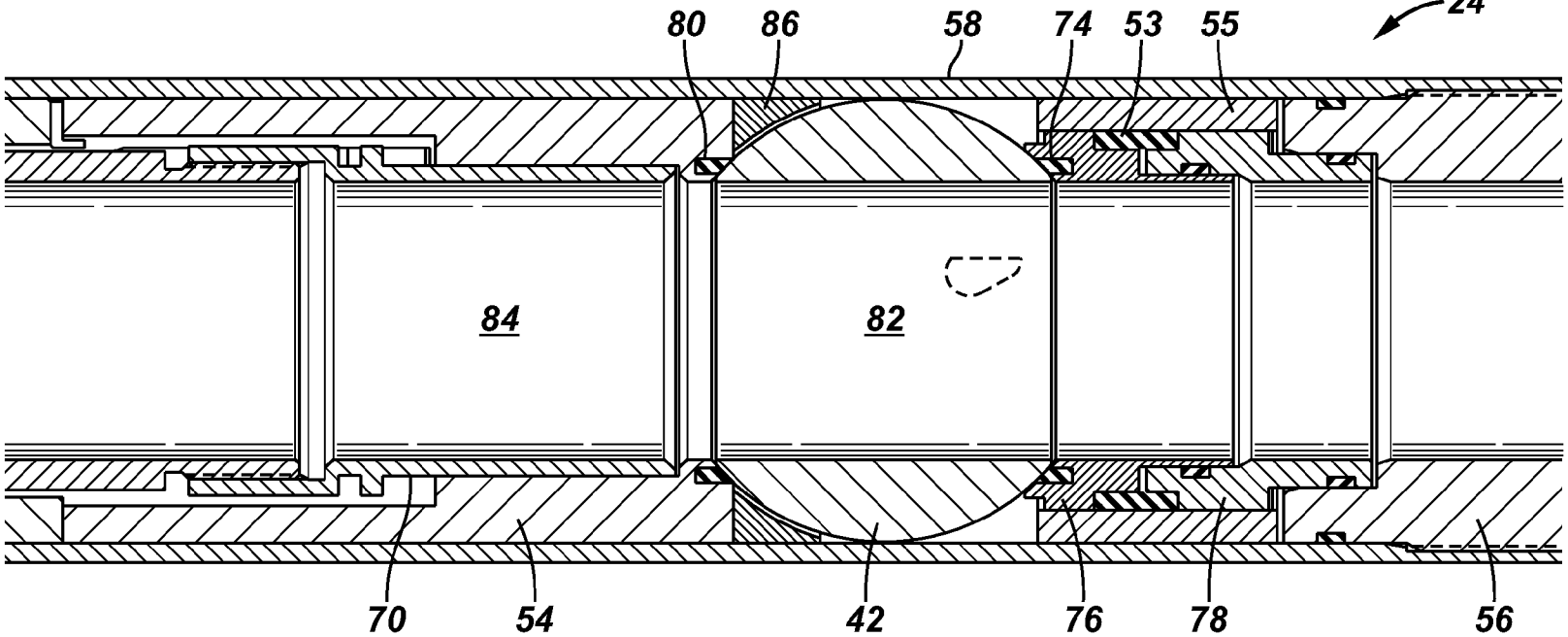
FIG. 3 is a cross-sectional view of the valve system illustrated in FIG. 2, according to an embodiment of the present disclosure.

In FIG. 3, a cross-sectional view is provided in which a cross-section has been taken generally through the rotational axis 50. In this embodiment, ball 42 is illustrated as contacted by a seal 74 disposed along one end of ball 42. The seal 74 is contained in a seal retainer 76 that maintains seal 74 in contact with ball 42 through the assistance of a seal follower 78. Seal retainer 76 may be biased against one end of ball 42 due to resilient member 53 provided within a cavity defined by seal retainer 76, seal follower 78, and intermediate housing 55. The resilient member 53 may be one or more wave springs for example. Placement of the resilient member 53 between the seal retainer 76, seal follower 78, and intermediate housing 55 allows for a more uniform continuous internal diameter through the formation isolation valve 24. Additionally, this configuration may make formation isolation valve 24 more debris tolerant due to the separation of resilient member 53 from the general flow stream of an open ball 42 within the formation isolation valve 24.

Additionally, a wiper 80 may be deployed against ball 42 to wipe the ball of debris as it is rotated and to thereby reduce the chance of debris preventing rotation of the ball. In the example illustrated, wiper 80 is a ring disposed on a side of ball 42 generally opposite seal retainer 76. The seal 74 and wiper 80 cooperate to facilitate dependable and repeatable motion of ball 42 as an interior flow passage 82 is transitioned between an open flow configuration (as illustrated in FIG. 3) and a closed configuration in which the ball is rotated to block flow through an interior 84 of formation isolation valve 24.

The wiper 80 may be formed from a variety of materials. For example, the wiper may be formed from polyetheretherketone (PEEK), brass, aluminum bronze, or other suitable materials. Additionally, the wiper 80 may be spring-loaded via an elastomeric material, a mechanical spring, or another suitable biasing member. The wiper 80 also may be formed as another seal to aid in preventing debris from entering the area surrounding ball 42. Prevention of debris accumulation also may be facilitated with a ball section filler 86 deployed in otherwise empty space located between ball 42 and the surrounding valve housing 58. By way of example, filler 86 may be formed from PEEK or another suitable material. The containment provided by seal 74 and wiper 80 enable arm or arms 60 to translate in an area generally sealed off from wellbore debris. It also should be noted that the locations of seal 74 and wiper 80 may be interchanged or otherwise altered to facilitate prevention of debris accumulation.

Figure 4:
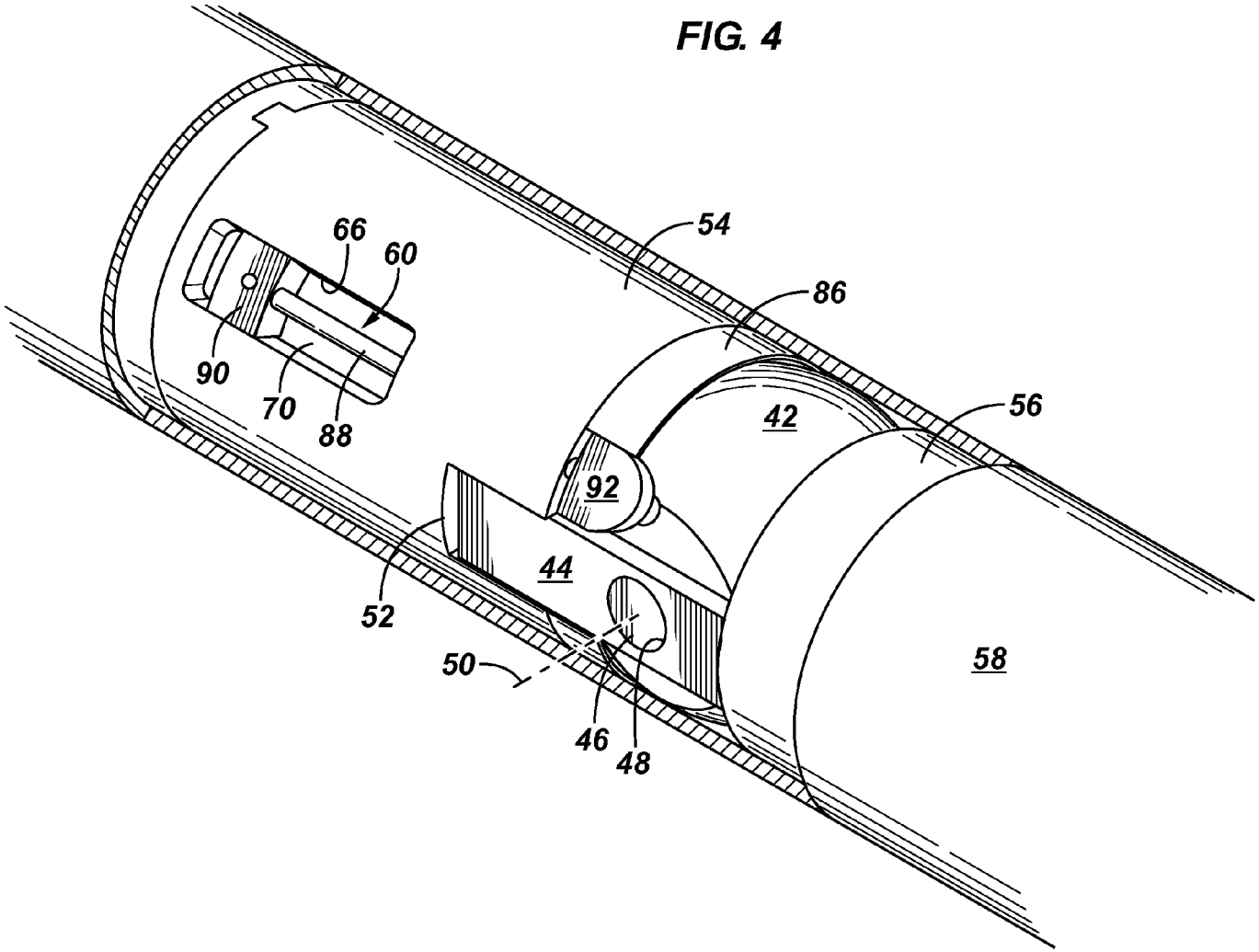
FIG. 4 is a partially broken away orthogonal view of another example of a formation isolation valve system, according to an alternate embodiment of the present disclosure.

Referring generally to FIG. 4, another embodiment of formation isolation valve 24 is illustrated. In this embodiment, a seal system and wiper system may be employed in a manner similar to or the same as that illustrated and described with reference to FIG. 3. However, the technique for transmitting load from mandrel 70 to ball 42 has been altered. Instead of using yoke arms, one or more, e.g. two, rods 88 are coupled between mandrel 70 and ball 42 (only one rod 88 is shown in this simplified view). The rods 88 are simple structures that are easy to manufacture and easy to utilize in manipulating ball 42. Each rod 88 is engaged with mandrel 70 via a connection mechanism 90. In some embodiments, more than one rod 88 may use a single connection mechanism 90. At an opposite end of each rod 88, a slider mechanism 92 may be used to couple the rods to ball 42.

By way of example, slider mechanism 92 connects the corresponding rod 88 to ball 42 at a position offset from the rotational axis 50. The slider mechanism 92 may be designed to provide pivotable engagement between rod 88 and ball 42 to enable rotational movement of ball 42 when mandrel 70 moves in a linear direction to drive connection mechanism 90. In this example, the rod 88 is able to pivot at both slider mechanism 92 and at connection mechanism 90 in order to accommodate rotation of ball 42. As illustrated in FIG. 4, window 66 may be used in cooperation with connection mechanism 90 to limit the linear translation of connection mechanism 90 in a manner that ensures movement of ball 42 to between a closed position and an open flow position.

Well system 20 (FIG. 1) may be constructed to facilitate perforating operations, but the well system also may be designed for use in a variety of other well applications. For example, flow isolation valve system 22 (FIG. 1) may be employed in many types of well servicing and production applications. Accordingly, the components deployed downhole and the conveyance systems used to deploy and/or retrieve components may vary according to the specific well applications. Additionally, the shape, size, and orientation of the well may be different depending on the environment, the types of formations, and the types of fluids held in the formation.

Also, the formation isolation valve 24 may be designed from a variety of materials and in a variety of sizes and configurations. The isolation valve 22 (FIG. 1) may be attached to or constructed as part of other downhole equipment. Additionally, one or more formation isolation valves may be utilized in the overall well system. The arrangements of seals and/or wipers may vary according to the specific applications and environment in which the formation isolation valve is utilized. Similarly, the materials and structure of the ball and other valve components may be adjusted according to the specific application.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

Although only a few embodiments of the present invention have been described in detail above, those of ordinary skill in the art will readily appreciate that many modifications are possible without materially departing from the teachings of this invention. Accordingly, such modifications are intended to be included within the scope of this invention as defined in the claims.

What is claimed is:

1. A system for isolating a formation, comprising:

a well string having a formation isolation valve, the formation isolation valve comprising:

a ball rotatably mounted in a pair of inserts, each insert being formed as a separate insert independently held in position in a corresponding pocket within a valve housing by an upper cage and a lower cage, the ball being rotatably mounted to the pair of inserts for rotation about a fixed axis without translation of the ball, the ball having a flow passage;

an arm coupled to the ball at a position offset from the fixed axis; and a mandrel connected to the arm, the mandrel being movable in a linear direction to force rotation of the ball, via the arm, between a closed position and an open position that allows flow of fluid along the flow passage.

2. The system as recited in claim 1, wherein the ball rotates on a ball trunnion that is rotatably received in at least one insert of the pair of inserts.

3. The system as recited in claim 2, wherein the at least one insert is housed in the upper cage on one side of the ball trunnion and held captive by the lower cage on an opposite side of the ball trunnion.

4. The system as recited in claim 1, wherein the arm comprises a yoke arm having an engagement end that moves through a slot formed in the ball.

5. The system as recited in claim 1, wherein the arm comprises a rod pivotably coupled to the ball.

6. The system as recited in claim 1, further comprising a seal retainer having a seal that is held against the ball.

7. The system as recited in claim 6, wherein the ball is a full ball and further comprising a wiper held against the full ball on a side of the full ball opposite the seal.

8. The system as recited in claim 1, wherein the ball is a full ball and further comprising a ball section filler positioned to fill an otherwise empty space between the full ball and the valve housing.

9. A method for isolating a formation, comprising:

forming a formation isolation valve with a ball having a flow passage;

rotatably mounting the ball within a pair of separately insertable inserts held within a valve housing to enable rotation of the ball about a fixed axis without translation of the ball;

connecting a first end of an arm to the ball at a position offset from the fixed axis, the first end being a terminal end of the arm; and coupling a second end of the arm to a movable mandrel to enable selective shifting of the ball between open and closed positions by movement of the arm.

10. The method as recited in claim 9, wherein forming comprises forming a full ball.

11. The method as recited in claim 9, wherein rotatably mounting comprises mounting a ball trunnion in an insert held by an upper cage and a lower cage.

12. The method as recited in claim 11, further comprising positioning the upper cage and the lower cage within a valve housing.

13. The method as recited in claim 9, wherein connecting comprises connecting the first end with a groove formed in the ball such that linear movement of the first end causes rotation of the ball.

14. The method as recited in claim 9, wherein connecting comprises connecting the first end of a rod to the ball.

15. The method as recited in claim 9, further comprising holding a seal against the ball via a resilient member not in direct contact with fluid in the flow passage.

16. The method as recited in claim 15, further comprising positioning a wiper against the ball.

* * * * *